US009041748B2

(12) United States Patent
Shin et al.

(10) Patent No.: US 9,041,748 B2
(45) Date of Patent: May 26, 2015

(54) DISPLAY DEVICE AND DRIVING METHOD THEREOF

(71) Applicant: Samsung Display Co., Ltd., Yongin-City, Gyeonggi-do (KR)

(72) Inventors: Kyoung Ju Shin, Hwaseong-si (KR); Jung-Taek Kim, Seoul (KR); Cheol Woo Park, Suwon-si (KR); Yun-Ki Baek, Suwon-si (KR); Bong Hyun You, Yongin-si (KR); Kyoung Won Lee, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 112 days.

(21) Appl. No.: 13/728,444

(22) Filed: Dec. 27, 2012

(65) Prior Publication Data

US 2014/0055501 A1 Feb. 27, 2014

(30) Foreign Application Priority Data

Aug. 22, 2012 (KR) ..... 10-2012-0091797

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 2320/062* (2013.01); *G09G 2320/0646* (2013.01)

(58) Field of Classification Search
None
See application file for complete search history.

(56) References Cited

U.S. PATENT DOCUMENTS

| | | | | |
|---|---|---|---|---|
| 6,614,418 | B2 | 9/2003 | Koyama et al. | |
| 6,856,308 | B2 | 2/2005 | Akimoto et al. | |
| 7,015,903 | B2 | 3/2006 | Lee | |
| 7,215,310 | B2 | 5/2007 | Song et al. | |
| 7,477,223 | B2 | 1/2009 | Sekiguchi et al. | |
| 7,932,889 | B2 | 4/2011 | Park | |
| 2004/0217954 | A1 | 11/2004 | O'Gorman et al. | |
| 2007/0216623 | A1* | 9/2007 | Kimura | 345/89 |
| 2008/0036721 | A1 | 2/2008 | Kim et al. | |
| 2010/0214330 | A1 | 8/2010 | Shishido et al. | |
| 2011/0157253 | A1* | 6/2011 | Yamazaki et al. | 345/690 |
| 2011/0205254 | A1* | 8/2011 | Umezaki et al. | 345/690 |
| 2012/0001954 | A1* | 1/2012 | Yamazaki et al. | 345/690 |
| 2012/0007896 | A1 | 1/2012 | Kwon et al. | |
| 2013/0038639 | A1* | 2/2013 | Han et al. | 345/690 |
| 2013/0106876 | A1* | 5/2013 | Lee et al. | 345/520 |

FOREIGN PATENT DOCUMENTS

| | | |
|---|---|---|
| JP | 2006-039337 | 2/2006 |
| JP | 4271414 | 3/2009 |
| KR | 1020040102918 | 12/2004 |
| KR | 10-0498634 | 6/2005 |
| KR | 1020060018393 | 3/2006 |
| KR | 10-0965591 | 6/2010 |
| KR | 10-1025800 | 3/2011 |
| KR | 1020110070234 | 6/2011 |
| KR | 1020130045608 | 5/2013 |

OTHER PUBLICATIONS

US2013-0106876 corresponds to KR10-2013-0045608.

* cited by examiner

*Primary Examiner* — Joseph Haley
*Assistant Examiner* — Emily Frank
(74) *Attorney, Agent, or Firm* — F. Chau & Associates, LLC

(57) ABSTRACT

A method of driving a display device includes driving a light source unit with a first driving ratio and outputting received image data to a display panel of the display device, storing the received image data upon receipt of a signal indicating a still image is displayed, calculating a second driving ratio of the light source unit from a representative value of the stored image data, compensating the stored image data according to the second driving ratio, driving the light source unit with the second driving ratio that is lower than the first driving ratio, and outputting the compensated image data to the display panel.

14 Claims, 8 Drawing Sheets

DISPLAY DEVICE AND DRIVING METHOD THEREOF

CROSS-REFERENCE TO RELATED APPLICATION

This application claims priority to Korean Patent Application No. 10-2012-0091797 filed in the Korean Intellectual Property Office on Aug. 22, 2012, the disclosure of which is incorporated by reference herein.

BACKGROUND (a) Technical Field

Embodiments of the present invention relate to a display device and a driving method thereof, and more particularly to a display device with reduced power consumption and a driving method thereof.

(b) Discussion of Related Art

A display device may be used in computer monitors, televisions, mobile phones, etc. As an example, the display device may be a cathode ray tube display device, a liquid crystal display, a plasma display device, etc.

The display device may include a graphics processing unit (GPU), a display panel, and a signal controller. The graphics processing unit transmits image data of a screen to be displayed on the display panel to the signal controller, and the signal controller generates a control signal for driving the display panel to transmit the control signal together with the image data to the display panel, thereby driving the display device.

Images displayed on the display panel may be classified as one of a still image and a motion picture. The display panel may display several frames per second. When the image data included in the frames are the same, the still image is displayed. Further, when the image data included in the frames are different, the motion picture is displayed.

The signal controller uses power each time it receives the same image data from the graphics processing unit. However, since this data is redundant, power is not being efficiently used.

SUMMARY OF THE INVENTION

At least one embodiment of the present invention provides a display device with reduced power consumption and a driving method thereof.

A driving method of a display device according to an exemplary embodiment of the present invention includes: transmitting input image data; driving a light source unit with a first driving ratio and outputting the input image data; storing the input image data if a still image start signal is applied; calculating a representative value of the stored image data and calculating a second driving ratio of the light source unit from the representative value; compensating the stored image data according to the second driving ratio; and driving the light source unit with the second driving ratio that is lower than the first driving ratio and outputting the compensated image data.

When the display panel displays a motion picture, the light source unit may be driven with the first driving ratio and the input image data may be output with a first frequency, and when the display panel displays a still image, the light source unit may be driven with the second driving ratio and the input image data may be output with a second frequency.

If the still image start signal is applied, the transmission of the input image data may be deactivated.

If the still image end signal is applied, the transmission of the input image data may be activated, the light source unit may be driven with the first driving ratio, and the input image data may be output.

In the calculation of the second driving ratio, the second driving ratio may be calculated to be as low as the representative value of the stored image data.

In the calculation of the second driving ratio, the second driving ratio may be calculated according to the representative value of the stored image data through an equation or a lookup table.

The representative value may be an average value or a maximum value of the stored image data.

In the compensation of the stored image data, the gray of the stored image data may be compensated to be as high as the second driving ratio is low.

The stored image data may include first color image data, second color image data, and third color image data, and the compensation of the stored image data may include compensating the first color image data, compensating the second color image data, and compensating the third color image data.

When changing the driving ratio of the light source unit, the driving ratio of the light source unit may be controlled to be gradually changed while having a value between the first driving ratio and the second driving ratio.

A display device according to an exemplary embodiment of the present invention includes: a display panel; a signal controller configured to generate control signals to drive the display panel; a graphics processing device configured to transmit input image data to the signal controller; a light source unit configured to provide light to the display panel; and a light source driver configured to generate control signals to drive the light source unit. The signal controller includes: a frame memory configured to store the input image data; a light source driving ratio selection unit configured to select a driving ratio of the light source unit; and an image data compensation unit configured to compensate the stored image data stored to the frame memory. The light source driving ratio selection unit selects the driving ratio of the light source unit as a first driving ratio when the display panel displays a motion picture, and selects the driving ratio of the light source unit as a second driving ratio that is lower than the first driving ratio when the display panel displays a still image, and the second driving ratio is changed according to a representative value of the stored image data.

The signal controller may further include a driving frequency selection unit to drive the display panel with a first frequency when the display panel displays the motion picture and with a second frequency that is lower than the first frequency when the display panel displays a still image.

The graphics processing device may transmit a still image start signal and a still image end signal to the signal controller.

The signal controller may store the input image data to the frame memory and may deactivate the transmission of the input image data if the still image start signal is applied, and may activate transmission of the input image data if the still image end signal is applied.

The second driving ratio may have a low value when a representative value of the stored image data is low.

The light source driving ratio selection unit may calculate the second driving ratio according to the representative value of the stored image data through an equation or a lookup table. The display device may include the lookup table storing driving ratios, where the driving ratio selection unit may select one of the stored driving ratios corresponding to the representative value as the second driving ratio.

The representative value may be an average value or a maximum value of the stored image data.

The image data compensation unit may compensate a gray of the stored image data to be as high as the second driving ratio is low.

The stored image data may include first color image data, second color image data, and third color image data, and the image data compensation unit may include: a first color image data compensation unit compensating the first color image data; a second color image data compensation unit compensating the second color image data; and a third color image data compensation unit compensating the third color image data.

The light source driving ratio selection unit may control the driving ratio of the light source unit to be gradually changed while having a value between the first driving ratio and the second driving ratio upon conversion of the motion picture and the still image. The driving ratio selection unit may select the second driving ratio by setting the driving ratio of the light source unit to a value between the first driving ratio and the second driving ratio before selecting the second driving ration.

A method of driving a display device according to an exemplary embodiment of the invention includes: driving a light source unit with a first driving ratio and outputting received image data to a display panel of the display device; storing the received image data upon receipt of a signal indicating a still image is displayed; calculating a second driving ratio of the light source unit from a representative value of the stored image data; compensating the stored image data according to the second driving ratio; driving the light source unit with the second driving ratio that is lower than the first driving ratio; and outputting the compensated image data to the display panel.

When the display panel displays a motion picture, the light source unit may be driven with the first driving ratio and the received image data may be output with a first frequency. When the display panel displays the still image, the light source unit may be driven with the second driving ratio and compensated image data may be output with a second frequency.

The method may further include deactivating an internal transmission of the image data within the display device upon receipt of the signal. The method may further include activating the internal transmission and driving the light source unit with the first driving ratio upon receipt of a signal indicating that display of the still image is to end.

The driving of the light source unit with the second driving ratio may include driving the light source unit with a driving ratio in between the first and second driving ratios before driving the light source unit with the second driving ratio.

A display device and a driving method thereof according to at least one exemplary embodiment of the present invention may decrease the driving ratio of a light source unit when displaying a still image to be dimming-driven, thereby reducing power consumption.

In at least one embodiment of the invention, compensated image data is output to a display panel according to the driving ratio change of the light source unit.

In at least one embodiment of the invention, reducing the driving frequency of the display panel when displaying the still image may further reduce the power consumption.

DETAILED DESCRIPTION

Figure 1:
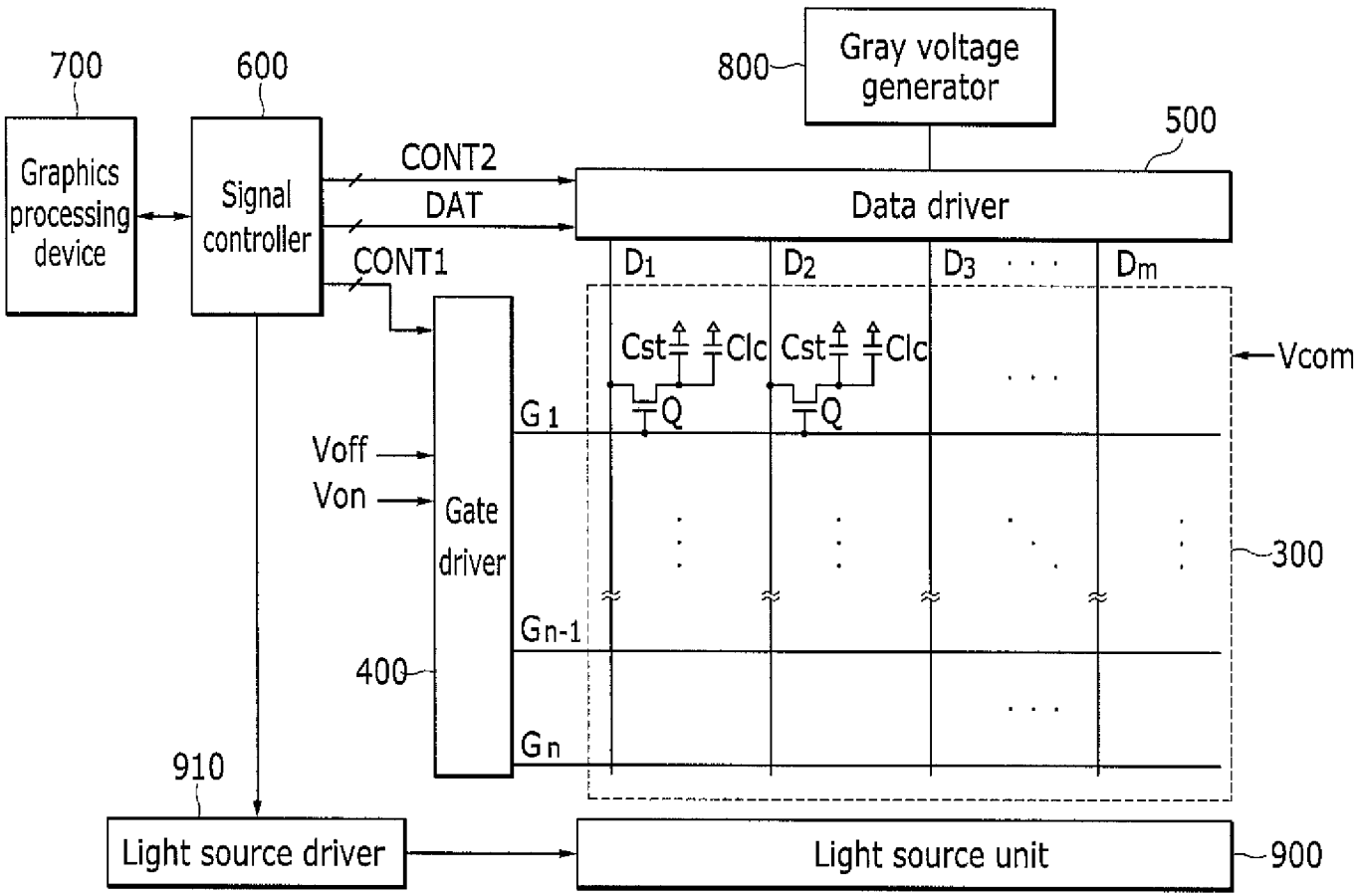
FIG. 1 is a block diagram of a display device according to an exemplary embodiment of the present invention.

The present invention will be described more fully hereinafter with reference to the accompanying drawings, in which exemplary embodiments of the invention are shown. However, the described exemplary embodiments may be modified in various different ways without departing from the spirit or scope of the present invention.

In the drawings, the thickness of layers, films, panels, regions, etc., may be exaggerated for clarity. Like reference numerals designate like elements throughout the specification. It will be understood that when an element such as a layer, film, region, or substrate is referred to as being "on" another element, it can be directly on the other element or intervening elements may also be present.

FIG. 1 is a block diagram of a display device according to an exemplary embodiment of the present invention.

As shown in FIG. 1, a display device according to an exemplary embodiment of the present invention includes a display panel 300 displaying an image, a signal controller 600 generating control signals to drive the display panel 300, and a graphics processing device 700 transmitting input image data to the signal controller 600.

The display panel 300 receives image data DAT from the signal controller 600 to display a still image and a motion picture. If a plurality of sequential frames have the same image data DAT, the still image is displayed, and if the plurality of sequential frames have different image data DAT, the motion picture is displayed.

The display panel 300 includes a plurality of gate lines G1-Gn and a plurality of data lines D1-Dm. The plurality of gate lines G1-Gn may extend in a horizontal direction, and the plurality of data lines D1-Dm may extend in a vertical direction while crossing the plurality of gate lines G1-Gn.

One of the gate lines G1-Gn and one of the data lines D1-Dm are connected with one pixel, and a switching element Q connected with one of the gate lines G1-Gn and one of the data lines D1-Dm is included in each pixel. A control terminal of the switching element Q is connected to the gate lines G1-Gn, an input terminal thereof is connected with the data lines D1-Dm, and an output terminal is connected with a liquid crystal capacitor Clc and a storage capacitor Cst.

The display panel 300 of FIG. 1 is shown as a liquid crystal panel. However the display panel 300 is not limited to any particular type. For example, the display panel 300 could be one of various types of display panels such as an organic light emitting panel, an electrophoretic display panel, and a plasma display panel, as well as the liquid crystal panel.

The signal controller 600 processes the input image data received from the graphics processing device 700 and control signals to generate image data DAT, a gate control signal CONT1, and a data control signal CONT suitable for operating the liquid crystal panel 300. For example, the control signals may include a vertical synchronization signal Vsync, a horizontal synchronization signal Hsync, a main clock signal MCLK, a data enable signal DE, etc.

In an exemplary embodiment, the gate control signal CONT1 includes a vertical synchronization start signal STV instructing an output start of a gate-on pulse (e.g., high time of a gate signal GS), a gate clock signal CPV controlling an output time of the gate-on pulse, etc.

In an exemplary embodiment, the data control signal CONT2 includes a horizontal synchronization start signal STH instructing an input start of the image data DAT, a load signal TP instructing application of the corresponding data voltage to the data lines D1-Dm, etc.

The graphics processing device 700 transmits the input image data to the signal controller 600. When the display panel 300 displays the motion picture, the graphics processing device 700 transmits the input image data to the signal controller 600 every frame. When the display panel 300 displays the still image, since the signal controller 600 already stores the image data received from the graphics processing device 700 during a previous frame, the graphics processing device 700 does not transmit the input image data to the signal controller 600. For example, when the display panel 300 displays the still image, the graphics processing device 700 may be deactivated.

The graphics processing device 700 transmits a still image start signal to the signal controller 600 at the conversion time when the input image data displaying the motion picture is transmitted, and then the input image data displaying the still image is transmitted. Further, the graphics processing device 700 transmits a still image end signal to the signal controller 600 at the conversion time when the input image data displaying the still image is transmitted, and then the input image data displaying the motion picture is transmitted.

The graphics processing device 700 may be configured to compare image data for at least two sequential frames before they are output to the signal controller. For example, if the graphics processing device 700 determines that image data for the next two sequential frames are the same, it can send the still image start signal to the signal controller 600 followed by the image data for one of the frames. Since the signal controller 600 receives the still image start signal before the still image data, it knows that the next image data it receives is to be displayed as the still image. For example, if the graphics processing 700 next encounters image data that differs from the still image, it can send the still image end signal to the signal controller followed by the different image data. Since the signal controller 600 receives the still image end signal before the different image data, it knows that the next image data it receives is to be displayed as the moving picture.

The display device according to an exemplary embodiment of the present invention may further include a light source unit 900 providing light to the display panel 300 and a light source driver 910 generating control signals for driving the light source unit 900.

The light source unit 900 may supply light to the inside of the display panel 300, and the supplied light may be emitted to the outside of the liquid crystal display panel 300 to display images. The light source unit 900 may be exemplified by various light sources. For example, the light source unit 900 may be a light emitting diode (LED), a cold cathode fluorescent lamp (CCFL), an external electrode fluorescent lamp (EEFL), etc. Further, in an exemplary embodiment, the light source unit 900 is classified into a side light type and a direct light type according to a layout form thereof.

In an exemplary embodiment, the light source driver 910 receives a driving ratio of the light source unit 900 from the signal controller 600 such that the light source unit 900 is driven with a corresponding driving ratio. For example, the signal controller 600 sends a first driving ratio to the light source driver 910 when a motion picture is displayed and sends a second driving ratio when a still image is displayed.

The light source driver 910 drives the light source unit 900 with the first driving ratio when the display panel 300 displays the motion picture. The first driving ratio as a constant ratio may be 100%, for example. For example, by supplying the highest voltage to the light source unit 900, the light source unit 900 may be driven at 100%. The highest voltage may be the highest power supply voltage the light source unit 900 is configured to receive.

The light source driver 910 drives the light source unit 900 with the second driving ratio when the display panel 300 displays the still image. The second driving ratio may be changed according to a representative value of the image data when displaying the still image. For example, the light source driver 910 controls the light source unit 900 through dimming driving when the display panel 300 displays the still image.

The dimming driving controls a light amount of the light source in consideration of luminance of the images. The dimming driving may prevent a contrast ratio (CR) of an image from being reduced and minimize power consumption. By analyzing a characteristic of the image to be displayed, the driving ratio of the light source unit 900 is decreased, thereby reducing the power consumption. However, the entire luminance of the screen decreases when the driving ratio of the light source unit 900 is decreased. Thus, in an exemplary embodiment of the present invention, the gray (or gray scale value) of the image data is compensated (e.g., increased) when the driving ratio is deceased to ensure that the displayed image appears with its intended brightness.

As an example, the power consumption of the light source unit 900 may be about 80% of the power consumption of the display device. Accordingly, decreasing the power consumption of the light source unit 900 may greatly decrease the amount of power consumed by the display device.

The dimming driving is used to decrease the power consumption. However, it can be difficult to analyze the image data for each frame to control the driving ratio of the light source unit 900. In an exemplary embodiment of the present invention, the dimming driving is not performed when the display panel 300 displays the motion picture, and the dimming driving is performed when displaying the still image. The same image is displayed during a plurality of frames when displaying the still image such that the driving ratio of the light source unit 900 is not controlled by analyzing the image data for each frame.

The display device according to an exemplary embodiment of the present invention may further include a gate driver 400 driving the gate lines G1-Gn and a data driver 500 driving the data lines D1-Dm.

The plurality of gate lines G1-Gn of the display panel 300 are connected to the gate driver 400, and the gate driver 400 may alternately apply a gate-on voltage Von and a gate-off voltage Voff to the gate lines G1-Gn according to the gate control signal CONT1 applied from the signal controller 600.

The display panel 300 may be formed by two substrates which face each other and are bonded to each other, and the gate driver 400 may be attached to one side edge of the display panel 300. Further, the gate driver 400 may also be mounted on the display panel 300 together with the gate lines G1-Gn, the data lines D1-Dm, and the switching elements Q. For example, the gate driver 400 may be formed on the display panel 300 when the gate lines G1-Gn, the data lines D1-Dm, and the switching elements Q are formed on the display panel 300.

The plurality of data lines D1-Dm of the display panel 300 are connected to the data driver 500, and the data driver 500 receives the data control signal CONT2 and the image data DAT from the signal controller 600. The data driver 500 converts the image data DAT into data voltages by using a gray voltage generated from a gray voltage generator 800, and transfers the converted data voltages to the data lines D1-Dm.

Figure 2:
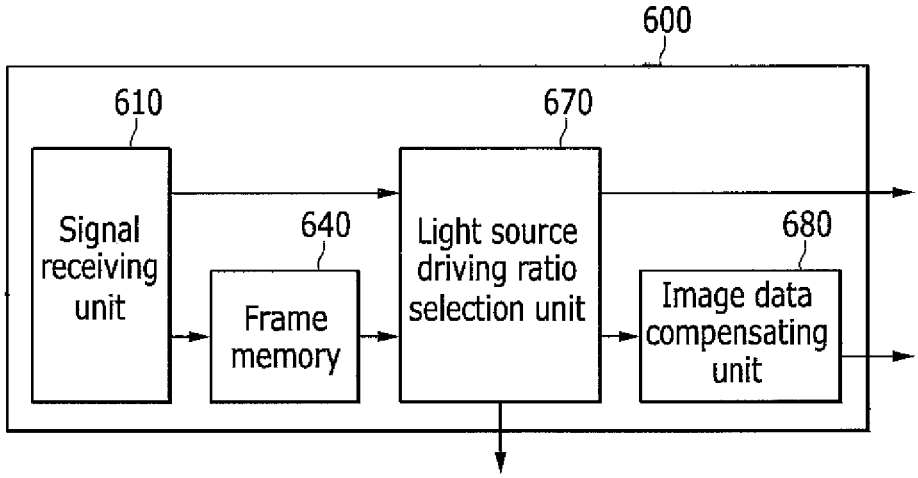
FIG. 2 is a block diagram of a signal controller of a display device according to an exemplary embodiment of the present invention.

FIG. 2 is a block diagram of a signal controller of a display device according to an exemplary embodiment of the present invention. The signal controller may correspond to the signal controller 600 of FIG. 1.

The signal controller 600 may include a signal receiving unit 610 receiving various signals from the graphics processing device 700, a frame memory 640 storing the input image data, a light source driving ratio selection unit 670 selecting a driving ratio of the light source unit 900, and an image data compensation unit 680 compensating the stored image data stored in the frame memory 640.

The signal receiving unit 610 receives the input image data, the still image start signal, and the still image end signal from the graphics processing device 700. Although not shown, in an exemplary embodiment, the signal receiving unit 610 is connected with the graphics processing device 700 through a main link and a sub-link. The main link and sub-link may be separate electrical lines. The signal receiving unit 610 receives the input image data from the graphic processing unit 700 through the main link. Further, the signal receiving unit 610 receives the still image start signal and the still image end signal from the graphics processing device 700 through the sub-link, and transmits a signal indicating a driving state of the display panel 300 to the graphics processing device 700.

The frame memory 640 receives and stores the input image data from the signal receiving unit 610. When the display panel 300 displays the motion picture, the frame memory 640 is not used. When the display panel displays the still image, the input image data is stored in the frame memory 640, and the stored image data stored in the frame memory 640 is outputted to the display panel 300.

If the signal receiving unit 610 receives the still image start signal, the input image data of one frame is stored to the frame memory 640 and the input image data is not applied from the graphics processing device 700. Also, if the signal receiving unit 610 receives the still image end signal, the input image data is again applied from the graphics processing device 700.

When the display panel 300 displays the motion picture, the light source driving ratio selection unit 670 selects the driving ratio of the light source unit 900 as the first driving ratio, and when the display panel 300 displays the still image, the driving ratio of the light source unit 900 is selected as the second driving ratio. As described above, the first driving ratio has the constant value, and the second driving ratio has a variable value. Accordingly, the light source driving ratio selection unit 670 may calculate the second driving ratio.

The light source driving ratio selection unit 670 analyses the stored image data stored to the frame memory 640 to calculate the representative value of the stored image data. The representative value as a value representing the gray (e.g., gray scale) of the stored image data may be an average value or a maximum value of the stored image data. When the average value is the representative value, power consumption may be greatly reduced, however accuracy of the image may be decreased. When the maximum value is the representative value, while the accuracy of the image may be increased, power consumption may not be reduced as much. However, the representative value may be calculated by various methods, and is not limited to being calculated from the average or maximum values.

The light source driving ratio selection unit 670 calculates the second driving ratio from the representative value of the stored image data. In an exemplary embodiment, as the representative value of the stored image data is decreased, the second driving ratio is also decreased. If the representative value of the stored image data is low, the image displayed by the display panel 300 may be a dark image based on use of a low driving ratio of the light source unit 900. The low driving ratio may be considerably lower than the 100% driving ratio used for the motion picture. Examples of the low driving ratio include 5%, 10%, 20%, etc. However, the prior provided low driving ratios are merely examples, as the low driving ratio is not limited to any particular value. In contrast, if the representative value of the stored image data is high, the image displayed by the display panel 300 may be a bright image based on use of a high driving ratio of the light source unit 900. The high driving ratio may be slightly less than the 100% driving ratio used for the motion pictures. Examples of the high driving ratio include 80%, 90%, 95%, etc. However, the prior provided high driving rations are merely examples, as the high driving ratio is not limited to any particular value. The second driving ratio may be proportional the intensity of the representative value. For example, if the highest grayscale value is 255, a representative value of 128 could yield a 50% duty ratio, and representative value of 64 could yield a 25% duty ratio.

The light source driving ratio selection unit 670 may use an equation or a lookup table to calculate the second driving ratio according to the representative value of the stored image data. For example, the lookup table may include multiple driving ratios, where each corresponds to a different representative value.

The image data compensation unit 680 compensates the stored image data according to the change of the driving ratio of the light source unit 900. As the second driving ratio is decreased, the gray of the stored image data is compensated to be increased. For example, a first value higher than a second value could be added to the gray values of stored image data to be driven with a 25% duty ratio, and the second value would then be added to stored image data to be driven with a 50% duty ratio.

When displaying the still image, a driving ratio of the light source unit 900 and a change of a highest gray of stored image data will be described with reference to FIG. 3.

Figure 3:
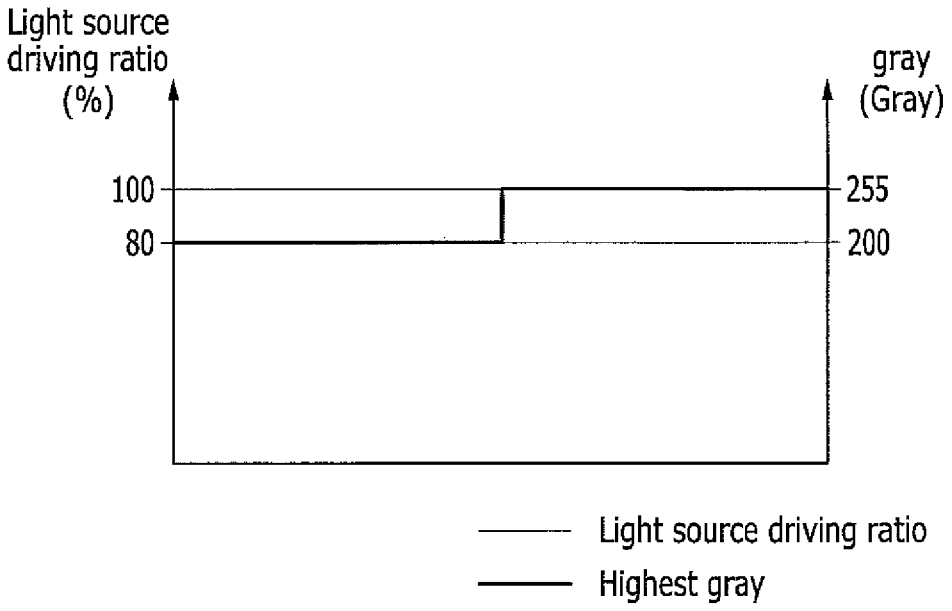
FIG. 3 is a graph showing a driving ratio of a light source unit and a change of a highest gray of stored image data in a display device according to an exemplary embodiment of the present invention.

FIG. 3 is a graph showing a driving ratio of a light source unit and a change of a highest gray of stored image data in a display device according to an exemplary embodiment of the present invention.

When displaying the motion picture, the light source unit 900 is driven at 100% (e.g., when the first driving ratio is 100%), and if the still image start signal is applied, the stored image data is analyzed such that the driving ratio of the light source unit 900 is decreased to 80% and is driven (when the second driving ratio is calculated as 80%). For example, when the highest gray of the stored image data is 200 gray, the highest gray of the stored image data may be compensated to be increased to 255 gray according to the decreased driving ratio of the light source unit 900. The luminance of the pixel having the image data of 200 gray when the light source unit 900 is driven at 100% may be the same as the luminance of the pixel having the image data of 255 gray when the light source unit 900 is driven at 80%. Also, the gray of all stored image data is compensated according to the changed driving ratio of the light source unit 900 and is output as the compensated image data.

The values of the first driving ratio, the second driving ratio, the stored image data, and the highest gray of the compensated image data are only illustrative examples, and may be changed.

In the above, if the still image start signal is applied, the driving ratio of the light source unit 900 is directly changed and the compensated image data according thereto is output, however the present invention is not limited thereto. In an exemplary embodiment, a conversion period is provided and the driving ratio of the light source unit 900 is gradually changed within the period. For example, if the conversion period is four frames and the driving ratio is to be changed from 100% to 20%, the driving ratio could be decreased 20% each subsequent frame.

The driving ratio of the light source unit 900 and the change of the highest gray of the stored image data in the conversion period will be described with reference to FIG. 4.

Figure 4:
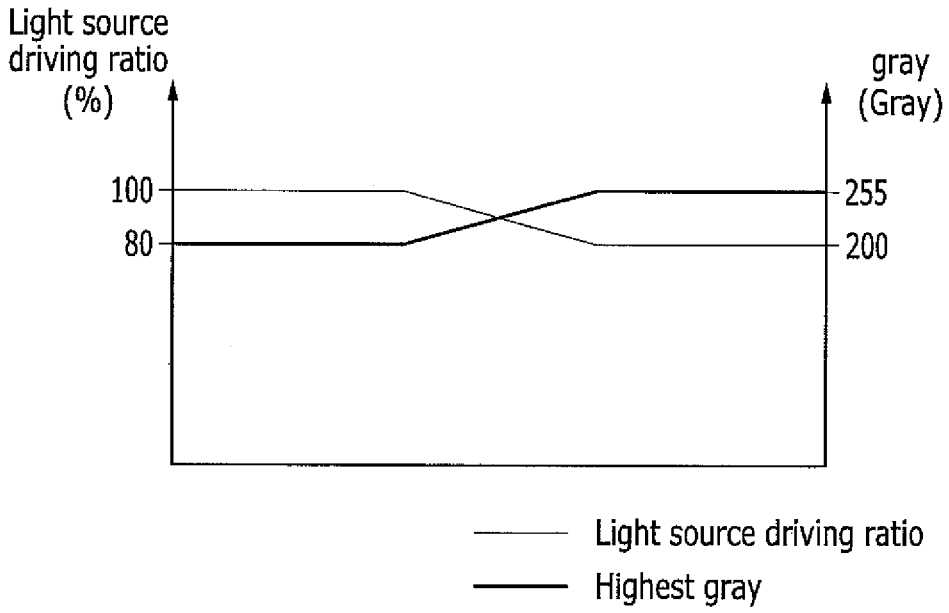
FIG. 4 is another graph showing a driving ratio of a light source unit and a change of a highest gray of stored image data in a display device according to an exemplary embodiment of the present invention.

FIG. 4 is another graph showing a driving ratio of a light source unit and a change of a highest gray of a stored image data in a display device according to an exemplary embodiment of the present invention.

In this example, the driving ratio of the light source unit 900 is not changed after the still image start signal is applied, and the driving ratio is controlled to be gradually changed with a value between the first driving ratio and the second driving ratio. For example, when the first driving ratio is 100% and the second driving ratio has a target value of 80%, the driving ratio of the light source unit 900 is decreased from 100% to an intermediate value between 80% and 100% (e.g., 90%) and then maintained when the driving ratio has the 80% target value in the conversion period.

Also, as the driving ratio of the light source unit 900 is gradually changed, the gray value of the compensated image data compensating the stored image data may be gradually changed. For example, the gray of the image data output in the conversion period has a value between the gray of the stored image data and the gray of the compensated image data and is gradually increased.

The conversion period may be set to have a time of more than one frame, for example, 30 frames.

The image data compensation unit 680 was described to compensate the gray of the stored image data according to the driving ratio of the light source unit 900. However, the present invention is not limited thereto as the gray compensation of the stored image data may be separately performed according to the color of pixel data within the stored image data.

The image data compensation unit 680 when the gray compensation of the stored image data is separately performed according to the color of the pixel data will be described with respect to FIG. 5.

Figure 5:
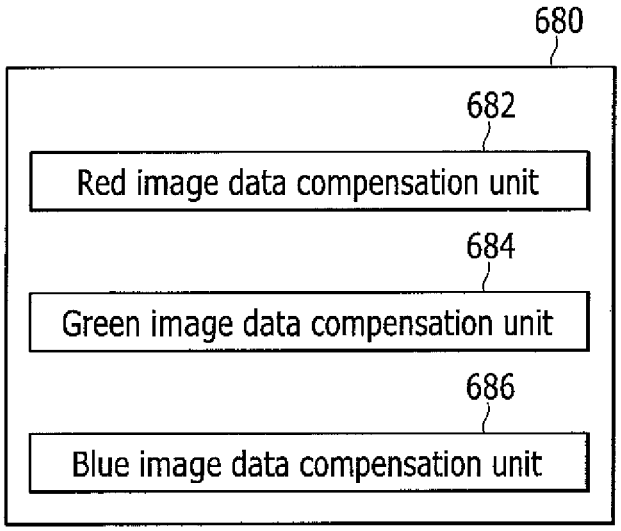
FIG. 5 is a block diagram of an image data compensation unit of a display device according to an exemplary embodiment of the present invention.

FIG. 5 is a block diagram of an image data compensation unit of a display device according to an exemplary embodiment of the present invention. The image data compensation unit may correspond to the image data compensation unit of FIG. 2.

The stored image data may be divided into image data representing several colors. For example, when pixels of the display panel 300 include a red pixel, a green pixel, and a blue pixel, the stored image data may include pixel data such as red image data, green image data, and blue image data. Different color coordinates may be provided for each color such that the luminance change of each pixel according to the change of the driving ratio of the light source unit 900 is different for each color. Accordingly, the compensation of the gray of the stored image data according to the change of the driving ratio of the light source unit 900 may be separately performed.

The image data compensation unit 680 may include a red image data compensation unit 682, a green image data compensation unit 684, and a blue image data compensation unit 686. The red image data compensation unit 682, the green image data compensation unit 684, and the blue image data compensation unit 686 may compensate the gray of the stored image data by different reference values by considering the color coordinates of each color.

In the above, the red, green, and blue pixels are described, however the present invention is not limited thereto as the display panel 300 may include various colored pixels. For example, one or more of the red, green, or blue pixels of the display panel 300 may be substituted with a magenta, yellow, cyan, or white pixel, or the display panel 300 may additional include one or more of the magenta, yellow, cyan, or white pixels.

A driving method of a display device according to an exemplary embodiment of the present invention will be described with reference to FIG. 1, FIG. 2, and FIG. 6.

Figure 6:
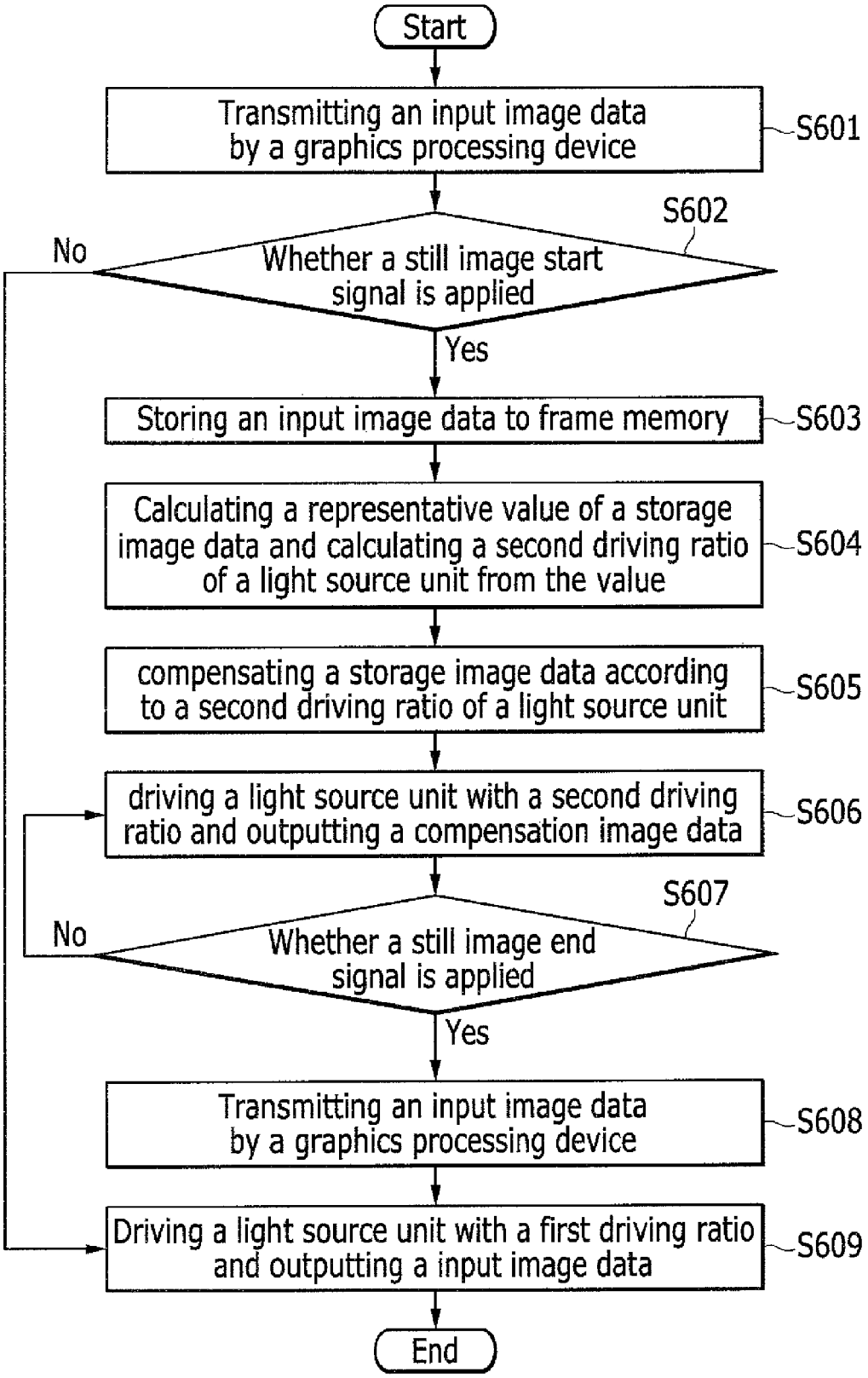
FIG. 6 is a flowchart of a method of driving a display device according to an exemplary embodiment of the present invention.

FIG. 6 is a flowchart of a method of driving method a display device according to an exemplary embodiment of the present invention.

The graphics processing device 700 transmits the input image data to the signal receiving unit 610 of the signal controller 600 (S601).

It is determined whether the signal receiving unit 610 is applied with the still image start signal (S602), and if the still image start signal is not applied, the light source unit 900 is driven with the first driving ratio and the input image data is output (S609). In an exemplary embodiment, the signal receiving unit 610 sets a first flag (or register) upon receipt of the still image start signal, and determines whether the still image start signal is applied by checking the contents of the first flag.

The light source driving ratio selection unit 670 selects the first driving ratio for the light source driver 910 to drive the light source unit 900 with the first driving ratio. The first driving ratio has a constant value.

The input image data is applied to the data driver 500 and the corresponding data voltage is output to the display panel 300, thereby displaying the image. The input image data is changed for each frame such that the display panel 300 displays the motion picture.

If the signal receiving unit 610 is applied with the still image start signal, the input image data is stored to the frame memory 640 (S603). The graphics processing device 700 may be deactivated when the input image data is stored to the frame memory 640 such that the graphics processing device 700 does not transmit the image data of a subsequent frame.

The representative value of the stored image data stored to the frame memory 640 is calculated, and the second driving ratio of the light source unit 900 is calculated from the representative value (S604).

The light source driving ratio selection unit 670 analyzes the stored image data to calculate the representative value of the stored image data, and the representative value may be the average value of the stored image data or the maximum value.

The light source driving ratio selection unit 670 may calculate the second driving ratio from the representative value of the stored image data by using an equation or a lookup table. When the representative value of the stored image data is low, the second driving ratio may be low. For example, if the representative value is 25/255, the driving ratio could be substantially lower than 100%, such as 5%, 10%, 15%, etc. However, these are merely examples of the low driving ratio as it may have various values.

The image data compensation unit 680 compensates the stored image data according to the second driving ratio of the light source unit 900 to generate the compensated image data (S605). When the second driving ratio is low, the gray of the stored image data is compensated to be increased. For example, the lower the second driving ratio, the more the stored image data is compensated. For example, the stored image data could be increased by a compensation value of 50 when the driving ratio is 50% and increased by a compensation value of 100 when the driving ratio is 25%. However, these are merely examples of the compensation value as it may have various values.

The pixels of the display panel 300 may include pixels displaying a plurality of colors. Each color has different color coordinates such that the compensation of the stored image data may be separately performed according to the different reference values for each color.

The light source unit 900 is driven with the second driving ratio, and the compensated image data is output (S606).

The light source driving ratio selection unit 670 calculates and selects the second driving ratio and the light source driver 910 drives the light source unit 900 with the second driving ratio. The compensated image data is applied to the data driver 500 and the corresponding data voltage is output to the display panel 300, thereby displaying the image. The compensated image data may have a constant value that enables the display panel 300 to display a still image.

It is determined whether the still image end signal is applied (S607), and if the still image end signal is not applied, the light source unit 900 is continuously driven with the second driving ratio and the compensated image data is output (S606). In an exemplary embodiment, the signal receiving unit 610 sets a second flag (or register) upon receipt of the still image end signal, and determines whether the still image end signal is applied by checking the contents of the second flag.

If the still image end signal is applied, the graphics processing device 700 is activated and the activated graphics processing device transmits the input image data (S608).

If the still image end signal is applied, the light source unit 900 is driven with the first driving ratio and the input image data is output (S609).

As described above, the driving ratio of the light source unit 900 is changed and the compensated image data is output after applying the still image start signal and the still image end signal, however the present invention is not limited thereto. The driving ratio of the light source unit 900 may be gradually changed from the first driving ratio to reach the second driving ratio during several frame periods after the still image start signal is applied. Also, the driving ratio of the light source unit 900 may be changed from the second driving ratio to the first driving ratio during several frames after the still image end signal is applied. As the driving ratio of the light source unit 900 is slowly changed, the gray value of the compensated image data may be gradually changed.

A display device according to an exemplary embodiment of the present invention will be described with reference to FIG. 1 and FIG. 7.

Figure 7:
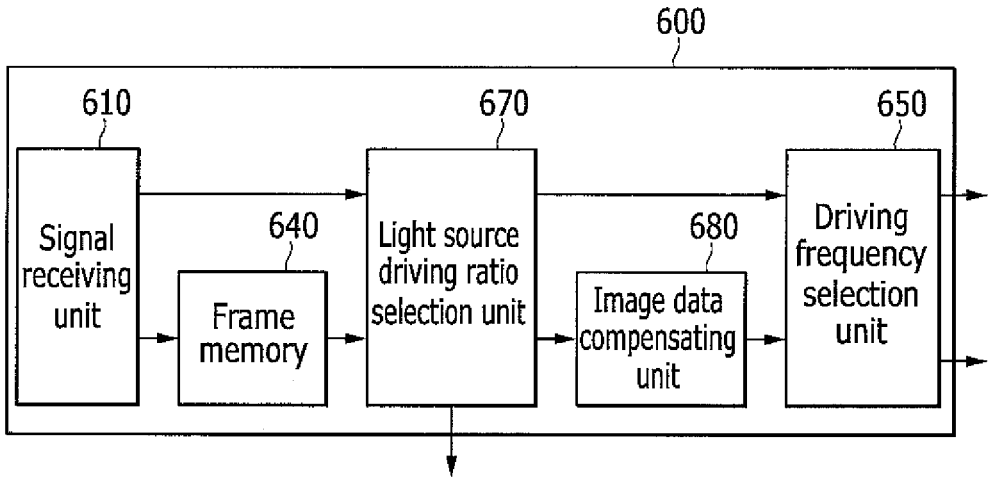
FIG. 7 is a block diagram of a signal controller of a display device according to an exemplary embodiment of the present invention.

FIG. 7 is a block diagram of a signal controller of a display device according to an exemplary embodiment of the present invention.

The display device is similar to the display device that uses the signal controller of FIG. 2. However, the driving frequency of the display panel using the signal controller of FIG. 7 differs from the display device using the signal controller of FIG. 2, which will be described in more detail below.

The display device that uses the signal controller of FIG. 7, as shown in FIG. 1, includes the display panel 300, the signal controller 600, the graphics processing device 700, the light source unit 900, and the light source driver 910.

As shown in FIG. 7, the signal controller 600 may further include a driving frequency selection unit 650 selecting a driving frequency of the display panel 300.

The driving frequency selection unit 650 selects a first frequency when the display panel 300 displays the motion picture and a second frequency when displaying the still image to control the driving frequency of the display panel 300.

The second frequency may be lower than the first frequency.

For example, the first frequency may be 60 Hz, which means that 60 frames are refreshed during one second. Also, the second frequency may be 10 Hz, which means that 10 frames are refreshed during one second. In this example, the power consumption is decreased by ⅙ when displaying the still image as compared with the motion picture. Accordingly, the frequency when displaying the still image is set to be less than that of the motion picture by a predetermined ratio, thereby reducing the power consumption. However, the invention is not limited to any particular pair of driving frequencies, as the first and second driving frequencies may be changed to various values.

If the frequency is decreased when the motion picture is displayed, the movement may appear unnatural. However the frame having the same image data DAT may be repeatedly refreshed when displaying the still image such that the unnatural appearance is not generated even though the frequency is decreased.

In the display device that uses the signal controller of FIG. 7, the driving ratio of the light source unit 900 is decreased when displaying the still image and the driving frequency of the display panel 300 is also decreased. Thus, the power consumption may be further reduced as compared to the display device that uses the signal controller of FIG. 2.

A method of driving a display device according to an exemplary embodiment of the present invention will be described with reference to FIG. 8.

Figure 8:
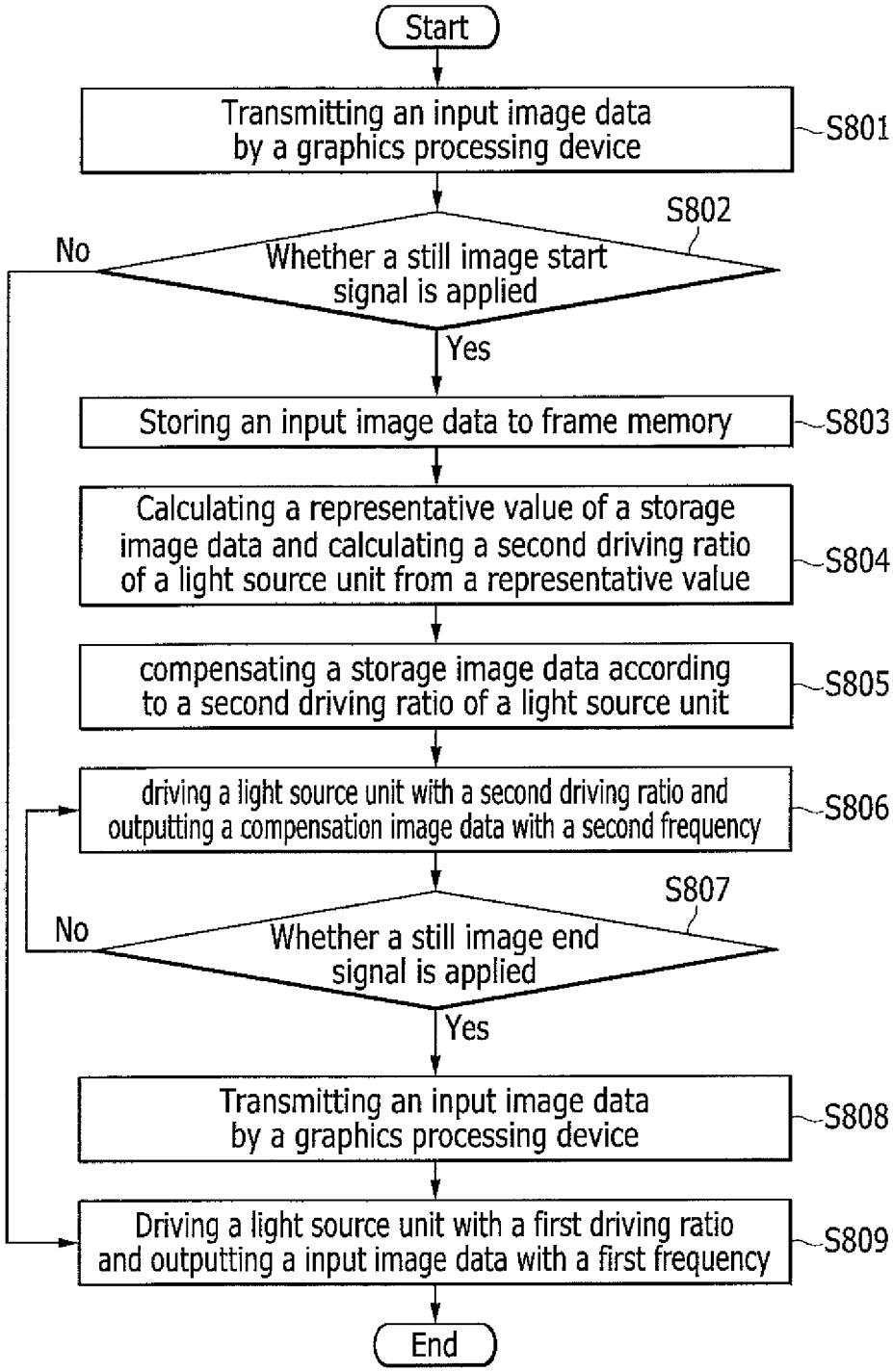
FIG. 8 is a flowchart of a method of driving a display device according to an exemplary embodiment of the present invention.

FIG. 8 is a flowchart of a method of driving a display device according to an exemplary embodiment of the invention that uses the signal controller of FIG. 7.

The driving method is similar to the driving method discussed with respect to the signal controller of FIG. 2.

The graphics processing device 700 transmits the input image data to the signal receiving unit 610 of the signal controller 600 (S801).

It is determined whether the signal receiving unit 610 is applied with the still image start signal (S802), and if the still image start signal is not applied, the light source unit 900 is driven with the first driving ratio, and the input image data is output with a first frequency (S809).

If the still image start signal is applied, the input image data is stored to the frame memory 640 (S803), the second driving ratio is calculated (S804), and the stored image data is compensated to generate the compensated image data (S805).

Next, the light source unit 900 is driven with the second driving ratio, and the compensated image data is output with a second frequency (S806).

Next, it is determined whether the still image end signal is applied (S807), and if the still image end signal is not applied, the light source unit 900 is still driven with the second driving ratio, and the compensated image data is output with the second frequency that is lower than the first frequency (S806).

If the still image end signal is applied, the graphics processing device 700 transmits the input image data (S808), the light source unit 900 is driven with the first driving ratio, and the input image data is output with the first frequency (S809).

While this invention has been described in connection with exemplary embodiments, it is to be understood that the invention is not limited to the disclosed embodiments, but, on the contrary, is intended to cover various modifications and equivalent arrangements included within the spirit and scope of the disclosure.

What is claimed is:

1. A method of driving a display device comprising:

driving a light source unit with a first driving ratio and outputting received image data to a display panel of the display device;

storing the received image data upon receipt of a signal indicating a still image is displayed;

calculating a second driving ratio of the light source unit from a representative value of the stored image data;

compensating the stored image data according to the second driving ratio;

driving the light source unit with the second driving ratio that is lower than the first driving ratio; and outputting the compensated image data to the display panel, wherein the light source unit provides light to the display panel, and wherein the driving of the light source unit with the second driving ratio comprises driving the light source unit with a driving ratio in between the first and second driving ratios before driving the light source unit with the second driving ratio.

2. The method of claim 1, wherein when the display panel displays a motion picture, the light source unit is driven with the first driving ratio and the received image data is output with a first frequency, and when the display panel displays the still image, the light source unit is driven with the second driving ratio and the compensated image data is output with a second frequency.

3. The method of claim 1, further comprising deactivating an internal transmission of the image data within the display device upon receipt of the signal.

4. The method of claim 3, further comprising activating the internal transmission and driving the light source unit with the first driving ratio upon receipt of a signal indicating that display of the still image is to end.

5. The method of claim 1, wherein in the calculation of the second driving ratio, the second driving ratio is calculated according to the representative value of the stored image data through an equation or a lookup table.

6. The method of claim 1, wherein the representative value is an average value or a maximum value of the stored image data.

7. The method of claim 1, wherein the stored image data comprises first, second, and third color data, and the compensation of the stored image data comprises compensating the first, second, and third color data.

8. A display device comprising:

a display panel;

a signal controller configured to generate control signals to drive the display panel;

a graphics processing device configured to transmit input image data to the signal controller;

a light source unit configured to provide light to the display panel; and a light source driver configured to generate control signals to drive the light source unit, wherein the signal controller comprises:

a frame memory configured to store the input image data;

a light source driving ratio selection unit configured to select a driving ratio of the light source unit; and an image data compensation unit configured to compensate the stored image data, wherein the light source driving ratio selection unit is configured to select the driving ratio of the light source unit as a first driving ratio when the display panel displays a motion picture, and select the driving ratio of the light source unit as a second driving ratio that is lower than the first driving ratio when the display panel displays a still image, and wherein the second driving ratio is changed according to a representative value of the stored image data, wherein the light source unit provides light to the display panel, and wherein the light source driving ratio selection unit selects the second driving ratio by setting the driving ratio of the light source unit to a value between the first driving ratio and the second driving ratio before selecting the second driving ratio.

9. The display device of claim 8, wherein the signal controller further comprises a driving frequency selection unit to drive the display panel with a first frequency when the display panel displays the motion picture and with a second frequency that is lower than the first frequency when the display panel displays the still image.

10. The display device of claim 8, wherein the graphics processing device is configured to transmit first and second signals to the signal controller, the first signal indicating display of a still image and the second signal indicating that display of the still image has ended.

11. The display device of claim 10, wherein the signal controller stores the input image data to the frame memory and deactivates the transmission of the input image data if the still image start signal is applied, and activates transmission of the input image data if the still image end signal is applied.

12. The display device of claim 8, wherein the light source driving ratio selection unit calculates the second driving ratio according to the representative value of the stored image data through an equation or a lookup table.

13. The display device of claim 8, wherein the representative value is an average value or a maximum value of the stored image data.

14. The display device of claim 8, wherein the stored image data comprises first, second, and third color data, and the image data compensation unit comprises:

a first color image data compensation unit compensating the first color data;

a second color image data compensation unit compensating the second color data; and a third color image data compensation unit compensating the third color data.

* * * * *